US005135134A

United States Patent [19]

Dancy

[11] Patent Number: 5,135,134

[45] Date of Patent: Aug. 4, 1992

[54] DEFORMABLE PLASTIC BAG DISPENSER

[76] Inventor: H. Gordon Dancy, 101 Pine Lake Dr., Hartsville, S.C. 29550

[21] Appl. No.: 638,495

[22] Filed: Jan. 7, 1991

[51] Int. Cl.[5] ..... B65H 1/00

[52] U.S. Cl. ..... 221/61; 221/63; 221/197; 221/155; 221/281; 225/6; 225/41; 225/53

[58] Field of Search ..... 221/33, 44, 45, 46, 221/50, 61, 63, 197, 281, 155; 225/6, 17, 39, 41, 53; 206/233, 407, 409, 410, 412, 555, 459

[56] References Cited

U.S. PATENT DOCUMENTS

| | | | |
|---|---|---|---|
| 2,005,490 | 6/1935 | Baxter | 221/63 X |
| 3,291,299 | 12/1966 | Minnotte, Jr. . | |
| 3,430,809 | 3/1969 | Vanstrom | 221/155 X |
| 4,191,307 | 3/1980 | LeCaire, Jr. et al. | 221/45 |
| 4,637,514 | 1/1987 | Kildea et al. . | |
| 4,714,191 | 12/1987 | Richardson . | |
| 4,805,800 | 2/1989 | Nocek et al. . | |
| 4,858,784 | 8/1989 | Moody | 221/155 |
| 4,871,093 | 10/1989 | Burshtain et al. . | |
| 4,936,452 | 6/1990 | Pauley . | |
| 5,024,349 | 6/1991 | Haenni et al. | 221/61 X |

FOREIGN PATENT DOCUMENTS

| | | |
|---|---|---|
| 1954486 | 6/1970 | Fed. Rep. of Germany . |

*Primary Examiner*—David H. Bollinger
*Attorney, Agent, or Firm*—Darby & Darby

[57] ABSTRACT

A package and dispenser for a continuous roll of plastic bags has a generally cylindrical shape and a longitudinal slot for dispensing the bags. Adjacent bags on the roll are attached by a perforated tear line. The dispenser is deformable to allow the operator to grip the roll by squeezing the dispenser, preventing further rotation of the roll, and allowing a bag to be removed from the roll. The dispenser is transparent, allowing indicia to be seen from a flyer inserted into the dispenser and around the roll. The flyer also blocks the slot so that bags cannot be removed during storage or shipping.

10 Claims, 2 Drawing Sheets

DEFORMABLE PLASTIC BAG DISPENSER

BACKGROUND OF THE INVENTION

This invention relates to a device for packaging and dispensing plastic bags. More specifically, the present invention relates to a combination packaging/dispensing device allowing individual plastic bags to be easily dispensed from a roll of bags, aided by squeezing the entire package.

Plastic bags are available in a large number of formats, including a continuous roll of bags, each separated by a tear line, which is usually perforated. There are also several designs available for dispensing the bags, many of them made from paperboard, although some exist in plastic.

An important feature for all these dispensers is how they provide for easy dispensing and separation of the bags, while keeping the overall design simple and inexpensive to manufacture. Paperboard dispensers are complicated to produce, requiring color printing of the blank to be formed into the dispenser in many cases, followed by cutting and scoring, folding, and finally, gluing. Plastic dispensers are not as widely used as paperboard dispensers, and they have their own production obstacles, such as affixing a label or other indicia to the dispenser.

It is an object of the invention to provide an improved package/dispenser for a continuous roll of plastic bags or other articles.

It is another object of the invention to provide a simple means of detecting when the roll of bags is almost depleted.

It is thus a feature of the invention to provide a dispenser made from a resilient, transparent material, having a generally cylindrical shape, wherein the dispenser may be deformed to grip the roll inside and aid in separating the bags.

It is also a feature of the invention to provide a package/dispenser having substantially the shape of a tennis ball container and having a narrow longitudinal slot there in for dispensing the plastic bags.

It is another feature of the invention that the longitudinal slot be provided with means for facilitating the removal of plastic bags from the roll.

It is also a feature of the invention that the roll of articles is surrounded by a flyer or other paper carrying indicia, such that the flyer covers the slot from the inside, preventing the removal of bags during shipping or storage and such that the flyer is visible due to the transparency of the dispenser.

The foregoing and other objects and advantages of this invention will become apparent to those skilled in the art upon reading the detailed description of a preferred embodiment in conjunction with a review of the appended drawings.

DETAILED DESCRIPTION OF THE PREFERRED EMBODIMENT

Figure 1:
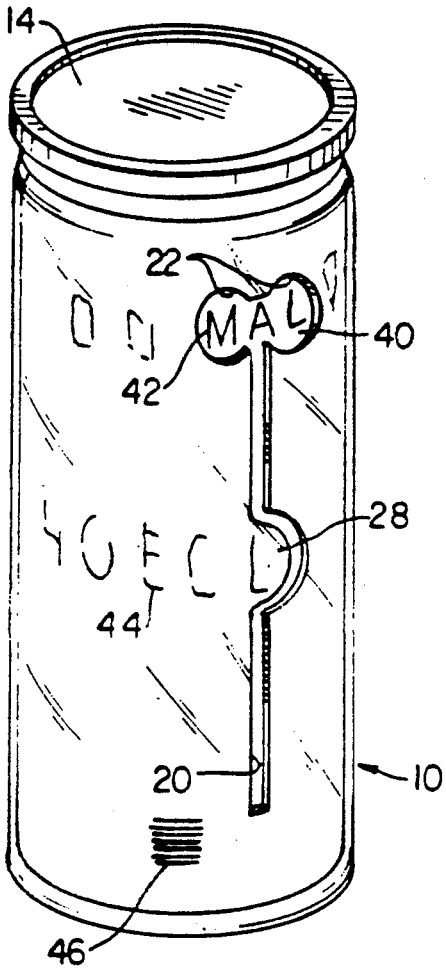
FIG. 1 is a perspective view of a preferred embodiment of the invention.
Figure 2:
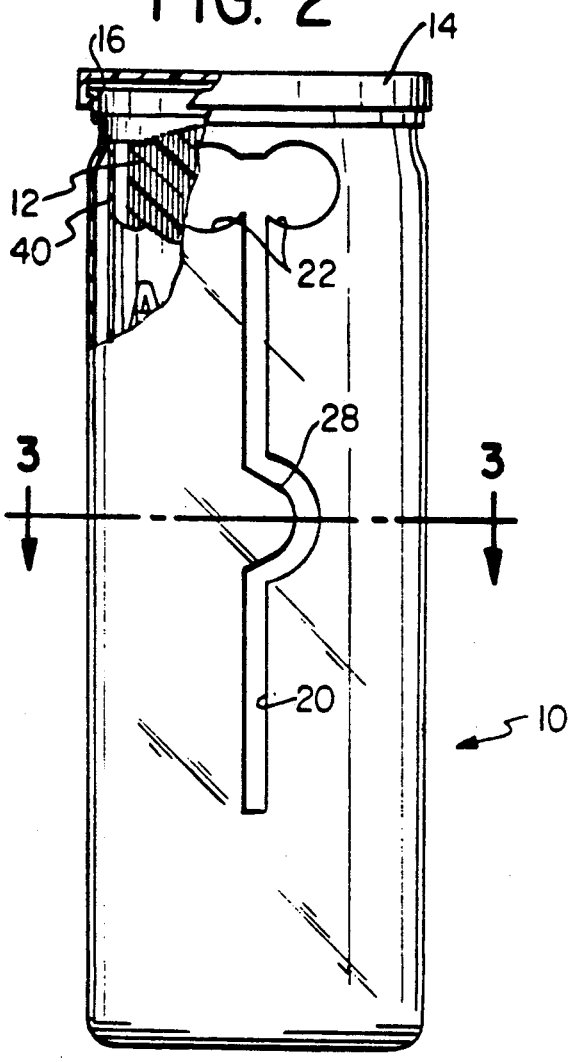
FIG. 2 is a partial longitudinal cross-section of the invention.
Figure 3:
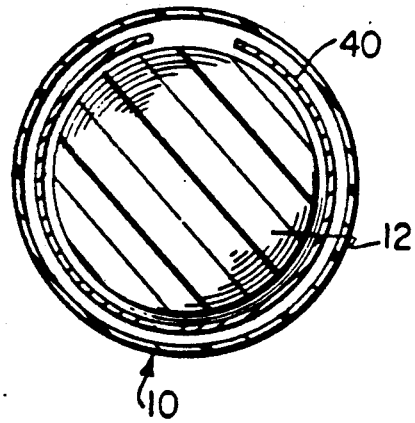
FIG. 3 is a sectional view taken along the line 3—3 of FIG. 1.
Figure 4:
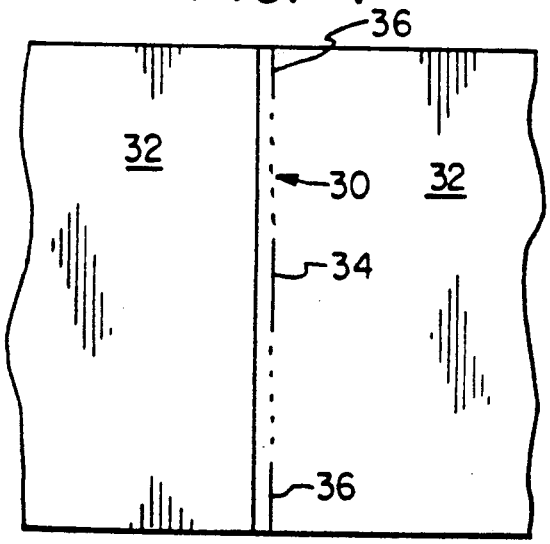
FIG. 4 is a top plan view of two bags, showing an embodiment of the tear line.
Figure 5:
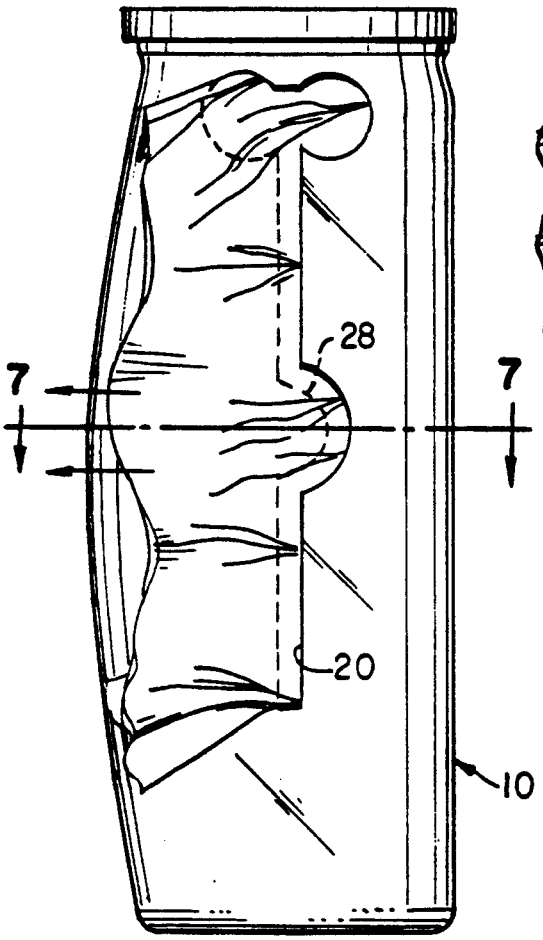
FIG. 5 is a side view of the invention, showing a bag partially dispensed and the dispenser slightly compressed.
Figure 6:
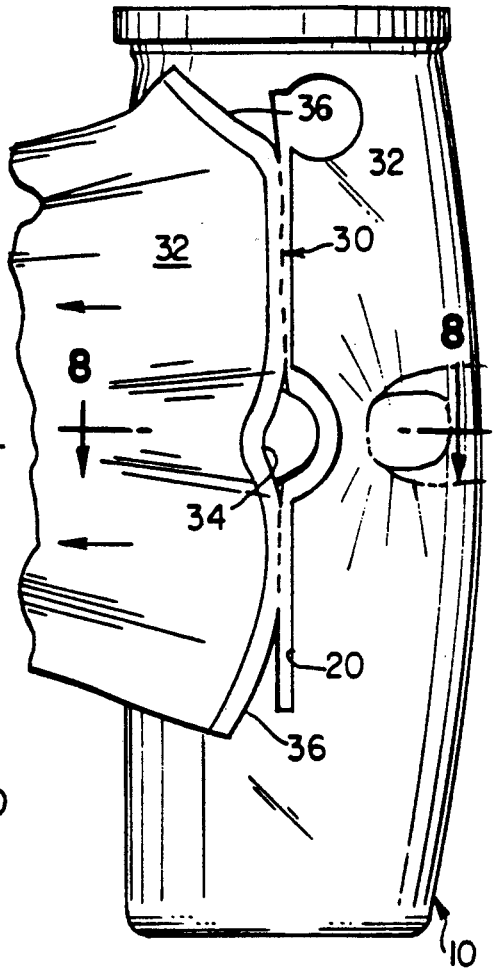
FIG. 6 is a side view of the invention, showing a bag being detached from an adjacent bag while the dispenser is compressed.
Figure 7:
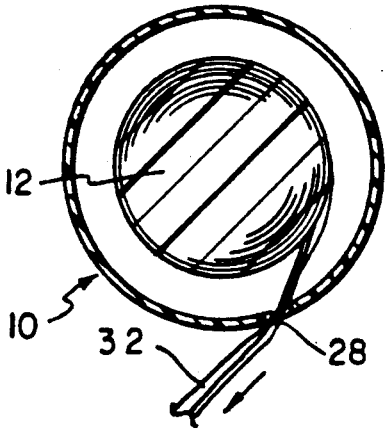
FIG. 7 is a sectional view taken along line 7—7 of FIG. 5.
Figure 8:
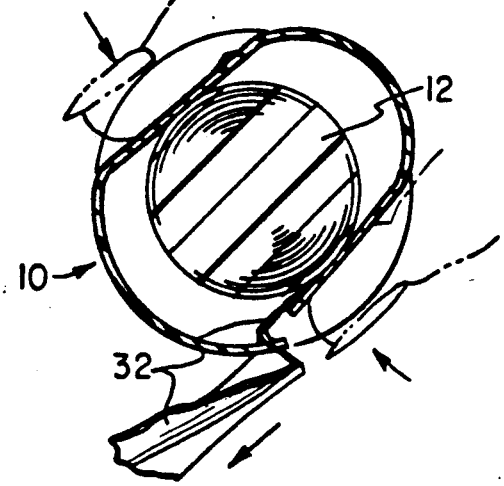
FIG. 8 is a sectional view taken along line 8—8 of FIG. 6.

A package/dispenser 10 is provided with a continuous roll of articles, preferably a roll of plastic bags 12. The dispenser 10 has a generally cylindrical shape, similar to a common plastic tennis ball container. The dispenser is provided with an open end 16 for inserting the roll of bags 12 and for aiding in their dispensing, described below. A plastic cap 14 can selectively cover the open end 16.

The dispenser 10 has a longitudinal slot 20, substantially parallel to the axis of the dispenser 10. The slot 20 is wide enough and long enough to allow individual bags 32 to be dispensed through it, but is preferably shorter than the length of the dispenser 10 and the width (axial dimension) of the roll 12. At the top end of the slot 20, are two overlapping finger holes 22, which are large enough so that two fingertips may be inserted through the holes 22 to grab the surface of the roll 12. In this manner, if no bag 32 is already protruding through the slot 20, the outermost bag 32 on the roll 12 can be pulled through the finger holes 22 first and then the slot 20. The finger holes are also placed near the open end 16 of the dispenser 10 such that if difficulty arises in grabbing the outermost bag from the roll, for example, if a user's fingers are too big for easy access through the holes 22, the cap 14 may be removed and the outermost bag may be easily pushed through the finger holes 22 from the inside of the dispenser 10.

The roll of bags 12 is made up of a series of individual bags 32 separated by tear lines 30. These tear lines 30 have perforations and may contain gaps 34,36. In the preferred embodiment, the tear line 30 has three gaps 34,36, one centrally located 34 and the other two 36 at each end of the tear line 30, although any configuration is possible. The gaps 34,36 can be made with a knife edge or formed during the creation of the tear line 30. Each bag 32 is preferably thermally sealed once, adjacent the tear line 30, as is known.

The slot 20 is curved at its center to provide a tongue 28 that enters the central gap 34 in the tear line 30 between adjacent bags 32 and aids in the separation of the bags. Since the slot 20 is shorter than the width of the bags 32, the end gaps 36 are captured at the ends of the slot 20 as the bag 32 passes through, further aiding in bag separation.

The dispenser 10 is made from a pliable material, such as a thermoplastic sheet, so that the dispenser 10 can easily be squeezed by an operator. It is possible to improve the durability of the slot 20 and the effectiveness of the tongue 28 by thickening the material around the slot. This can be accomplished during manufacture, for example, by passing cool air over the area during thermoforming. When the dispenser 10 is squeezed, the inside surface of the dispenser 10 will come into frictional contact with the side of the roll of bags 12 and resist or stop its rotation. The user's squeezing and gripping of the roll 12 permits a bag 32 protruding outside the dispenser 10 to be easily pulled away from the roll 12. Owing to the deformability of the dispenser 10, the roll 12 does not have to be secured inside the dispenser 10 and may float freely within. As the bags 32 are depleted, even a small roll 12 can be gripped by applying an appropriate squeezing force to the dispenser 10.

The dispenser 10 is also provided with a flyer 40 that is inserted around the roll 12, inside the dispenser 10. This flyer 40 serves several purposes. The flyer 40 will cover the slot 20 from the inside during shipping, storage, and display, thus preventing any bags 32 from accidentally slipping through the slot 20 or being easily stolen. In the preferred embodiment, the dispenser 10 is formed of a tranparent material, so the flyer 40 can be seen through the dispenser 10. All manner of indica 42 can be put on the flyer 40, including all product-identifying information and marketing information 44. This greatly reduces printing costs, as printing on paper is significantly cheaper and easier than printing on plastic or on pressure-sensitive labels, especially in color. A standard (UPC) barcode 46 can also be printed on the flyer and can be scanned through the transparent dispenser at automated checkout counters.

By making the dispenser 10 of a transparent material, the remaining number of bags inside the dispenser 10 is easily seen during each use. In many cardboard dispensers, using the last bag can often be a surprise. The dispenser 10 can also include one or more flattened sides to aid in shipping and storage and to prevent the dispensers from rolling on store shelves. These flattened sides would not affect the operation of the dispenser 10.

While the embodiment of the invention shown and described is fully capable of achieving the results desired, it is to be understood that this embodiment has been shown and described for purposes of illustration only and not for purposes of limitation. It is therefore contemplated that many additions, modifications, and substitutions could be made without departing from the scope and spirit of the invention as defined in the accompanying claims.

What is claimed is:

1. A device for dispensing a continuous roll of substantially flat articles, comprising;

a hollow body having first and second ends, one of said ends being open for receiving said roll and the other end being closed, said body also having a longitudinal slot extending between said ends for less than the length of said body between said ends, said slot being dimensioned and positioned such that said articles may pass through said slot for dispensing, said body being formed of a resilient material such that said body may be squeezed to frictionally engage said roll when present therein to resist rotation of said roll and to assist in separating articles from said roll;

a flyer made of sheet material mounted completely within said body so as to extend about said roll, said flyer being longer than said slot in the direction of said slot and is positioned to prevent articles from passing through said slot, said flyer being removed from said body only through said open end before dispensing articles; and a cap, detachably mounted at said open end of said body so as to prevent said roll and said flyer from passing through said open end.

2. A device as in claim 1 wherein said body is formed of a light-transmitting material, whereby the user may visually determine when the supply of articles is being depleted.

3. A device as in claim 2 wherein said flyer is constructed so as to be capable of receiving indicia that are visible through said body.

4. A device as in claim 3 wherein said indicia include a machine-readable barcode.

5. A device as in claim 1 wherein adjacent ones of said articles are partially separated by a tear line having perforations.

6. A device as in claim 5 wherein said tear line further comprises at least one elongated gap between said adjacent articles.

7. A device as in claim 1 wherein said slot includes a finger hole near one end of said slot, said hole allowing access to said roll to assist in dispensing said articles through said slot.

8. A device as in claim 7, wherein said one end of said slot is near said open end of said body.

9. A device for dispensing a continuous roll of substantially flat articles, comprising;

a hollow body having first and second ends, one of said ends being open for receiving said roll and the other end being closed, said body also having a longitudinal slot extending between said ends for less than the length of said body between said ends, said slot being dimensioned and positioned such that said articles may pass through said slot for dispensing, said body being formed of a resilient material such that said body may be squeezed to; frictionally engage said roll when present therein to resist rotation of said roll and to assist in separating articles from said roll;

a flyer made of sheet material mounted in said body so as to extend about said roll, said flyer being positioned to prevent articles from passing through said slot, said flyer being removed from said body before dispensing articles;

a cap, detachably mounted at said open end of said body so as to prevent said roll and said flyer from passing through said open end, wherein adjacent ones of said articles are partially separated by a tear line having perforations, said tear line further comprises at least one elongated gap between said adjacent articles; and a tongue extending generally laterally with respect to the slot and positioned to be received in one of said at least one gap so as to assist in completely separating said articles.

10. A device as in claim 9, having at least two gaps positioned at the ends of said tear line, said gaps engaging the ends of said slot to assist in completely separating said articles.

* * * * *